US008091798B2

(12) United States Patent
Bonds

(10) Patent No.: US 8,091,798 B2
(45) Date of Patent: Jan. 10, 2012

(54) SAFETY STRAW AND METHOD OF USE THEREOF

(76) Inventor: Monty Bonds, Lawrenceville, GA (US)

( * ) Notice: Subject to any disclaimer, the term of this patent is extended or adjusted under 35 U.S.C. 154(b) by 159 days.

(21) Appl. No.: 12/106,412

(22) Filed: Apr. 21, 2008

(65) Prior Publication Data

US 2009/0261116 A1 Oct. 22, 2009

(51) Int. Cl.
*A47G 21/18* (2006.01)

(52) U.S. Cl. ..... 239/12; 239/24; 239/33

(58) Field of Classification Search ..... 239/24, 239/33, 288–288.5, 12
See application file for complete search history.

(56) References Cited

U.S. PATENT DOCUMENTS 1,034,837 A * 8/1912 Rollefson ..... 239/25
2,052,496 A * 8/1936 Stassi ..... 215/229
2,689,149 A 9/1954 Saltzman
3,409,224 A * 11/1968 Harp et al. ..... 239/33
4,037,361 A * 7/1977 Murphy et al. ..... 47/48.5
5,114,074 A 5/1992 Frauenthal et al.
5,335,851 A * 8/1994 Adaska et al. ..... 239/33
5,395,322 A * 3/1995 Moser et al. ..... 604/77
5,671,863 A 9/1997 Uliana
6,427,928 B1 8/2002 Hirota et al.
6,585,170 B2 7/2003 Katsukawa
6,629,624 B2 10/2003 Stillinger et al.

* cited by examiner

*Primary Examiner* — Christopher Kim
(74) *Attorney, Agent, or Firm* — Williamson Intellectual Property Law, LLC; Thomas R. Williamson, III

(57) ABSTRACT

A safety straw comprising a barrier for use with or incorporated as part of a straw, wherein the straw comprises a bendable segment, and wherein the barrier prevents the straw from being inserted too far into a person's mouth. The barrier comprises a mouthpiece that retains the conventional shape of a straw and is preferably molded as a unit with the straw. Alternatively, the barrier may be separately formed and installed on an existing straw. Further, the barrier may comprise a circular disk with a hole in the center thereof. To use, a user inserts the straw with the barrier into their mouth, wherein the barrier prevents the user from inserting the straw too far into their mouth.

8 Claims, 3 Drawing Sheets

SAFETY STRAW AND METHOD OF USE THEREOF

CROSS-REFERENCE TO RELATED APPLICATIONS

None

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field of the Invention

The present invention relates generally to a safety straw and method of use thereof, and more specifically to a safety straw comprising a straw and a barrier, wherein the straw comprises a bendable segment, and wherein the barrier comprises a mouthpiece that retains the conventional shape of a straw, and wherein the barrier is disposed above the bendable segment of the safety straw.

2. Description of Related Art

Typically, if a person does not want to directly drink liquid from a container, the person places a straw into the container to consume the liquid therein. However, usually nothing prevents a person from inserting a straw too far into his/her mouth. As such, the person may choke on the straw or the straw may scratch the back of the person's throat. Such a possibility causes not only a discomfort, but can cause serious injury or even death if the person swallows and/or chokes on the straw.

One method of eliminating the possibility of a young infant and/or a disabled adult from choking on a straw is utilization of a mouthpiece. One previous device teaches a mouthpiece that engages to a tip end of a straw body both internally and externally. However, while this device stops the straw from being inserted into the person's mouth too far, the device does not retain the conventional tubular shape of the straw, and further requires that the straw have external and internal mating surfaces to engage the mouthpiece.

Another previous device teaches a retraction resistant straw. This device comprises a downward facing wedge or cone, the latter forming a circular surface with a center point that attaches to the body of the straw. This device does not prevent a large length of the straw from entering the mouth, but rather prevents removal of the straw after the straw is inserted into a carton, thereby keeping the container and the straw together to prevent the loss of the straw and/or spillage of the contents of the container. However, because the barrier of this device is disposed below the bendable segment of the straw, it allows an excessive amount of possible penetration of the straw into the mouth that could lead to choking and/or discomfort.

Therefore, it is readily apparent that there is a need for a straw having a barrier that does not change the conventional tubular shape of the straw, wherein the barrier limits the length of the straw that can be taken into the mouth, thereby preventing a user from choking.

BRIEF SUMMARY OF THE INVENTION

Briefly described, in a preferred embodiment, the present invention overcomes the above-mentioned disadvantages and meets the recognized need for such an apparatus by providing a safety straw comprising a straw and a barrier. The straw typically comprises a bendable segment and the barrier comprises a mouthpiece that retains the conventional tubular shape of the straw, wherein the barrier is disposed above the bendable segment of the straw, thereby limiting the length of the straw above the barrier to prevent the user from inserting the straw too far into his or her mouth.

Accordingly, one advantage of this apparatus is that it could be formed as a unitary barrier/straw structure making it easy to produce and utilize. Unlike other devices, the safety straw would not need to be assembled. As such, infants and/or incapacitated adults would not have the cumbersome or awkward task of attaching a separate mouthpiece to a straw. Alternatively, the barrier could be made as a separate component that is subsequently assembled to an existing straw by sliding thereon. In such an embodiment, the barrier could be reutilized after suitable cleaning/disinfecting.

According to its major aspects and broadly stated, the present invention in its preferred form is a safety straw comprising a tubular section and a barrier, the straw having a bendable segment near a top portion of the tubular section, wherein the barrier is disposed above the bendable segment of the tubular section, thereby limiting the length of the straw that can be inserted into the mouth. The barrier comprises a mouthpiece with a top for a user to drink liquid, a flange and an end that is molded to the tubular section of the straw.

The barrier may be molded directly as part of the tubular section, forming the straw and barrier as a unit, or, alternatively, in another embodiment, the barrier may be manufactured individually and subsequently attached to a straw. For this latter embodiment, the bendable segment of the straw comprises ridges that are larger in diameter than the diameter of the end of the barrier, thereby limiting travel of the barrier beyond the bendable segment of the straw. It will be recognized by those skilled in the art that the barrier may slide loosely on the straw or may frictionally engage the straw.

In an alternative embodiment, the barrier comprises a circular disk having a hole in the center thereof, wherein the disk slides onto a straw having a bendable segment. The bendable segment of the straw comprises ridges, wherein the ridges are larger in diameter than the hole of the barrier and prevent the barrier from sliding past the bendable segment of the straw.

The safety straw provides a method of drinking liquid. The user obtains a safety straw having a barrier section molded thereinto proximate the drinking end of the straw. The user then places the other end of the safety straw into a container holding liquid. The user then places the mouthpiece of the barrier into his/her mouth and creates suction, whereby the liquid travels up the straw and through the mouthpiece, while the barrier prevents the user from pulling too long a portion of the straw into his/her mouth, eliminating possible choking.

Alternatively, the safety straw provides a method of drinking liquid by obtaining a straw with a bendable segment and securing a barrier thereon, wherein the barrier comprises a circular disk having a hole in the center thereof. The user slides the barrier over the top of the straw and onto the straw until the barrier is impeded in further travel by ridges of the bendable segment of the straw. The user then places the straw into a container holding liquid and places the drinking end of the straw into his or her mouth, wherein the barrier prevents the straw from being inserted too far into the user's mouth.

Structurally, the barriers of the embodiments described above comprise a hollow opening surrounded by an annular extension, wherein the annular extension contacts the lips of the user, and prevents further insertion of the barrier and/or straw into a user's mouth.

Thus, the safety straw provides an apparatus capable of transporting liquid into a user's mouth, while preventing the user from choking on the straw.

More specifically, the present invention is a safety straw, wherein the safety straw comprises a straw and a barrier molded as a unit with the straw, and wherein the barrier comprises a mouthpiece having a top through which liquid flows. A flange on the barrier prevents entry of the straw too far into a person's mouth and an end portion of the barrier is molded to the straw. The straw comprises a bottom, a bendable segment and a top portion, wherein the bendable segment comprises ridges that permit adjustment of the position of the straw, and wherein the top portion is joined to the end of the mouthpiece, and wherein liquid enters the straw at the bottom of same.

In use, an infant and/or incapacitated person inserts the safety straw into a container holding liquid. The user then places the mouthpiece into his/her mouth and sips liquid. The barrier prevents the straw from being inserted too far into the user's mouth.

In another embodiment of the safety straw, the safety straw comprises a removable barrier that attaches to a straw sliding thereon, wherein the barrier comprises a mouthpiece for the user to insert into his/her mouth and a end, and wherein the mouthpiece comprises a flange and a top. The straw comprises a bottom for insertion into a container, a bendable segment for angular adjustment, and a top portion whereon the removable barrier is disposed. The bendable segment comprises ridges forming a flexible section, wherein the ridges are wider than the end of the removable barrier, thereby preventing the barrier from moving past the bendable section.

In use, a user slides the removable barrier over the top of the straw until the end of the detachable barrier contacts the ridges of the straw. The user places the bottom of the straw into the container holding liquid. The user then places the mouthpiece of the detachable/removable barrier into his or her mouth and sips liquid, whereby the liquid travels through the bottom of the straw and to the user through the top of the detachable barrier.

In another alternate embodiment, the safety straw comprises a detachable barrier, wherein the detachable barrier attaches to a straw, and wherein the barrier comprises a circular disk with a hole in the center thereof. The straw comprises a bottom, a bendable segment and a top, wherein the bendable segment comprises ridges and the ridges are larger in diameter than the hole of the detachable barrier.

In use, the user slides the detachable barrier over the top of the straw until the detachable barrier meets the ridges of the straw, the ridges impeding further travel. The user then places the bottom of the straw into a container holding liquid. The user then places the top of the straw into his or her mouth and sips liquid, wherein the liquid travels through the bottom of the straw to the user. The user selectively adjusts the position of the straw via the accordion ridges of the flexible, bendable section, wherein the accordion ridges are such as is known in the art for forming a bendable segment of a tubular structure.

Accordingly, a feature and advantage of the present invention is its ability to allow a user to safely and comfortably drink liquid via a straw.

Another feature and advantage of the present invention is its ability to prevent a user from choking on a straw.

Still another feature and advantage of the present invention is its ability to secure a limited entry barrier onto an existing straw, while still retaining the functionality of a conventional straw.

Yet another feature and advantage of the present invention is its ability to incorporate a molded barrier as a unitary portion of a straw.

Still another feature and advantage of the present invention is its ability to allow a child or incapacitated adult to easily and safely drink from a straw.

These and other features and advantages of the present invention will become more apparent to one skilled in the art from the following description and claims when read in light of the accompanying drawings.

BRIEF DESCRIPTION OF THE SEVERAL VIEWS OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATE EMBODIMENTS OF THE INVENTION

In describing the preferred and selected alternate embodiments of the present invention, as illustrated in FIGS. 1A-3B, specific terminology is employed for the sake of clarity. The invention, however, is not intended to be limited to the specific terminology so selected, and it is to be understood that each specific element includes all technical equivalents that operate in a similar manner to accomplish similar functions.

Figure 1A:
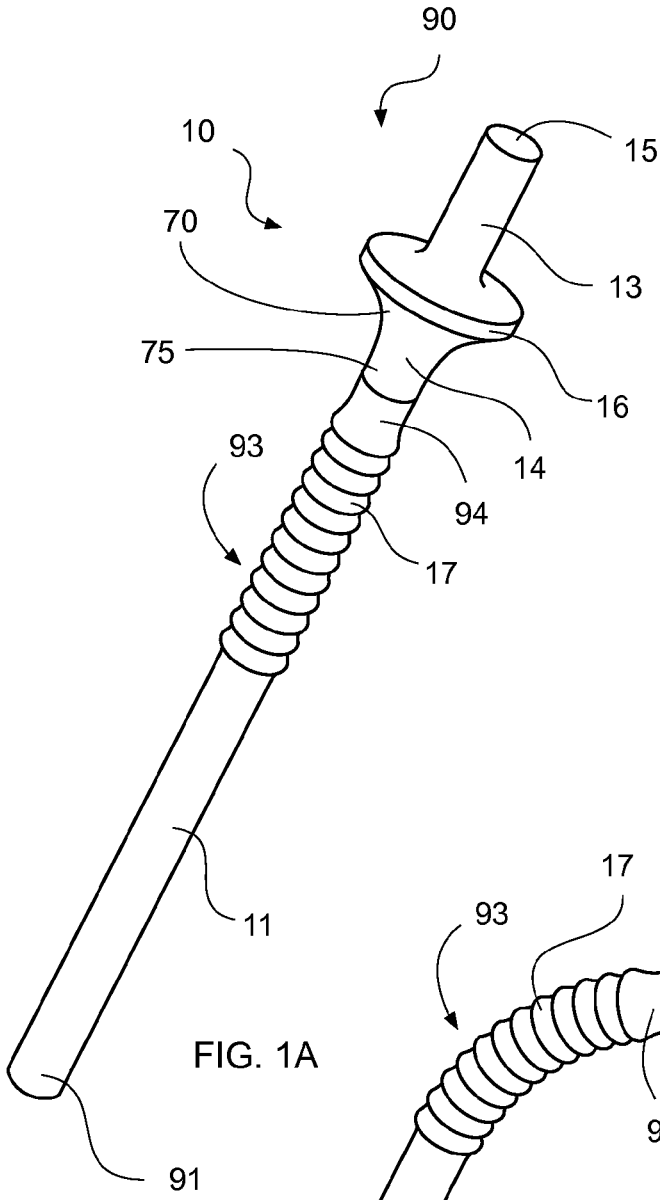
FIG. 1A is a perspective view of a safety straw according to a preferred embodiment.
Figure 1B:
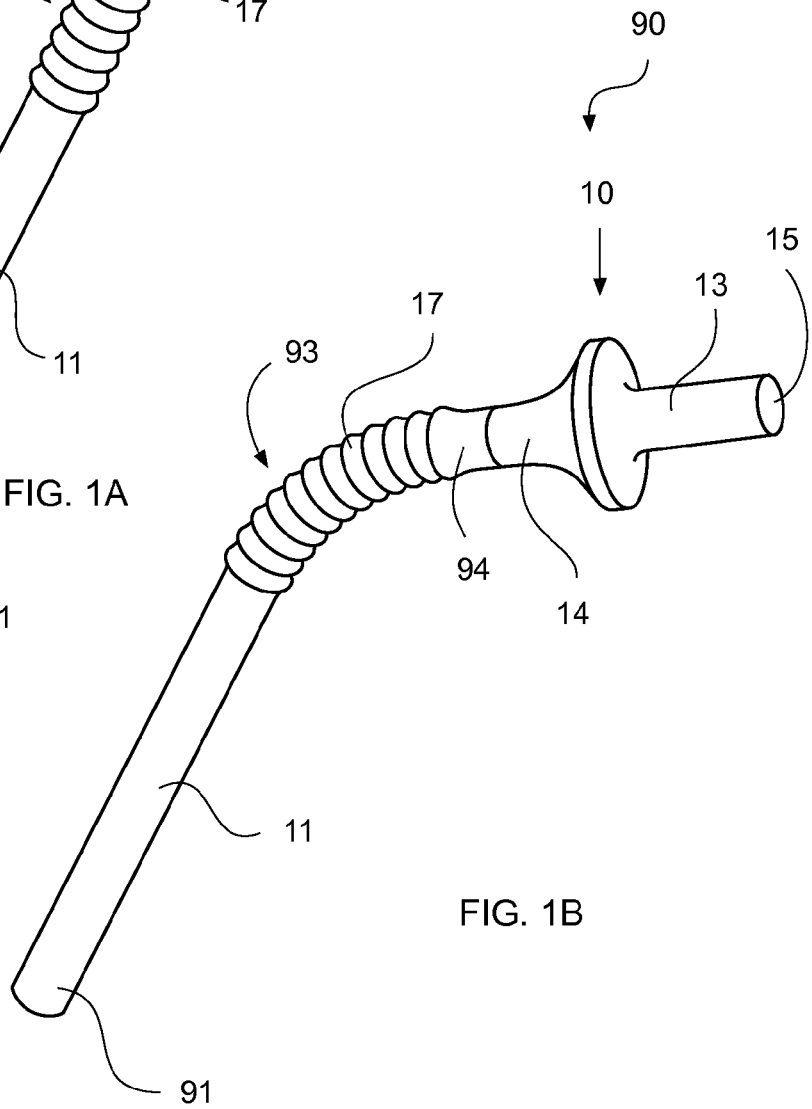
FIG. 1B is a perspective view of a safety straw according to a preferred embodiment, showing the straw in bent form.

Referring now to FIGS. 1A-1B, a preferred embodiment comprises safety straw 90, wherein safety straw 90 comprises straw 11 and barrier 10, wherein barrier 10 comprises mouthpiece 13, disc-shaped flange 16 and trumpet-flare-shaped portion 14, and wherein mouthpiece 13 comprises top 15. Trumpet-flare-shaped portion 14 comprises first end 70 and second end 75, wherein first end 70 is larger in diameter than second end 75. Straw 11 comprises bottom 91, bendable segment 93 and top portion 94, wherein top portion 94 is in fluid communication with end 14, wherein barrier 10 is molded unitarily as part of straw 11. Bendable segment 93 comprises accordion ridges 17 as such are known in the art to selectively adjust straw 11. Safety straw 90 is tubular in shape as is known in the art.

Figure 2:
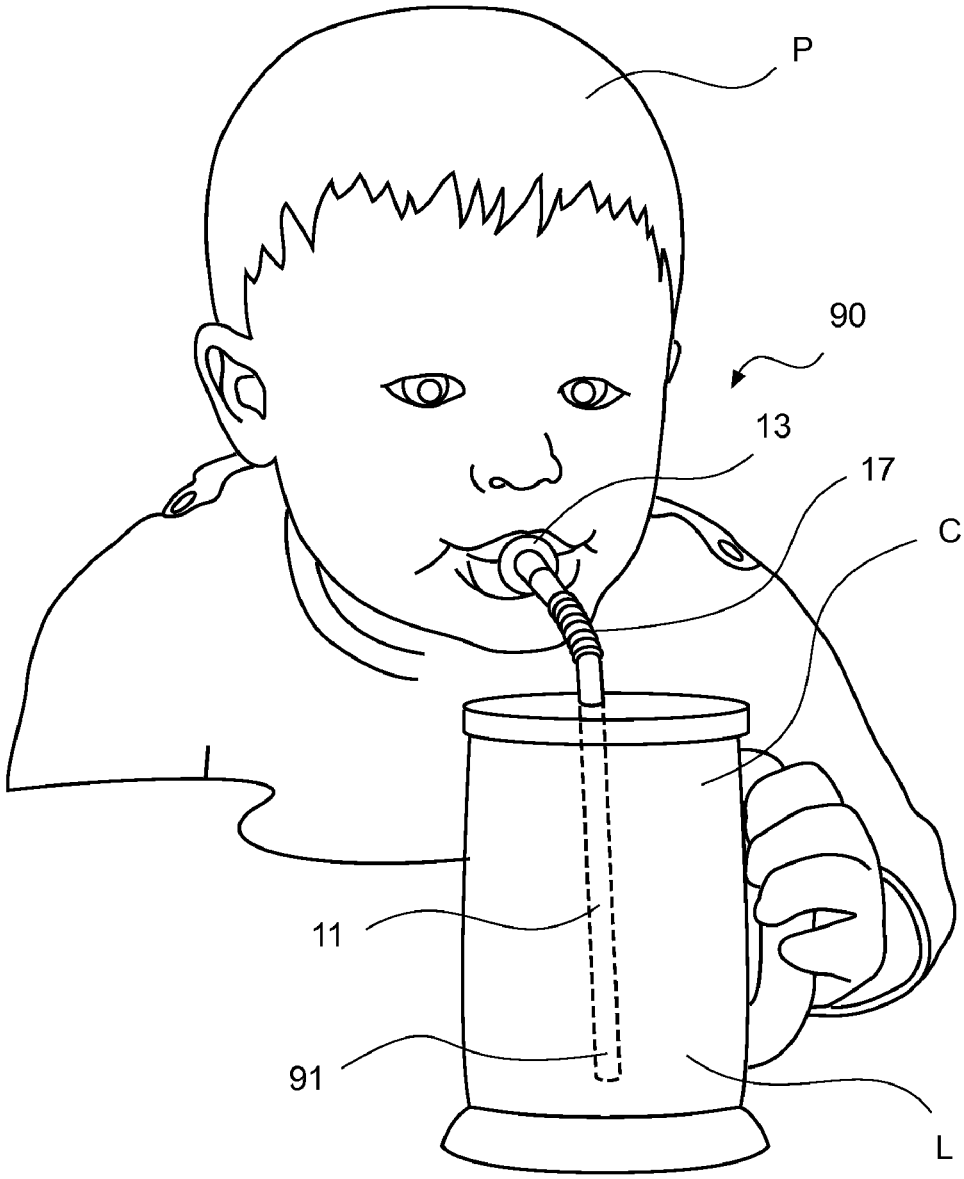
FIG. 2 is a perspective view of a safety straw according to a preferred embodiment, shown in use.

Referring now to FIG. 2, in use, an assistant helping an infant and/or incapacitated person P places safety straw 90 into container C holding liquid L. Person P then places mouthpiece 13 into his or her mouth and sips liquid L, whereby liquid L travels through bottom 91 of straw 11 passing therethrough to person P, wherein liquid L exits mouthpiece 13.

Figure 3A:
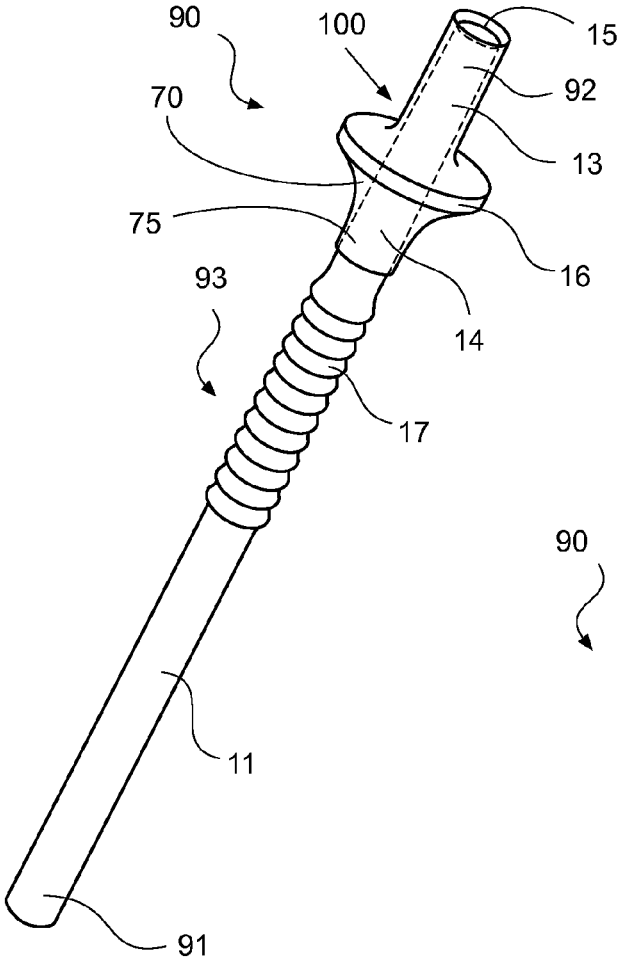
FIG. 3A is a perspective view of a safety straw with a removable barrier thereon according to an alternate embodiment.

Referring now to FIG. 3A, the present invention in a preferred embodiment comprises safety straw 90, wherein safety straw 90 comprises straw 11 and removable barrier 100. Removable barrier 100 comprises mouthpiece 13, disc-shaped flange 16 and trumpet-flare-shaped portion 14, wherein mouthpiece 13 comprises top 15. Trumpet-flare-shaped portion 14 comprises first end 70 and second end 75, wherein first end 70 is larger in diameter than second end 75. Straw 11 comprises bottom 91, bendable segment 93 and top 92, wherein bendable segment 93 comprises accordion-fold ridges 17 to facilitate flexing of bendable segment 93, and wherein ridges 17 extend annularly wider than end 14.

In use, person P slides removable/detachable barrier 100 over top 92 until end 14 contacts ridges 17. Person P places straw 11 into container C holding liquid L (best shown in FIG. 2). Person P then places mouthpiece 13 into his or her mouth and sips liquid L, whereby liquid L travels through bottom 91 to person P via straw 11 exiting top 15.

Figure 3B:
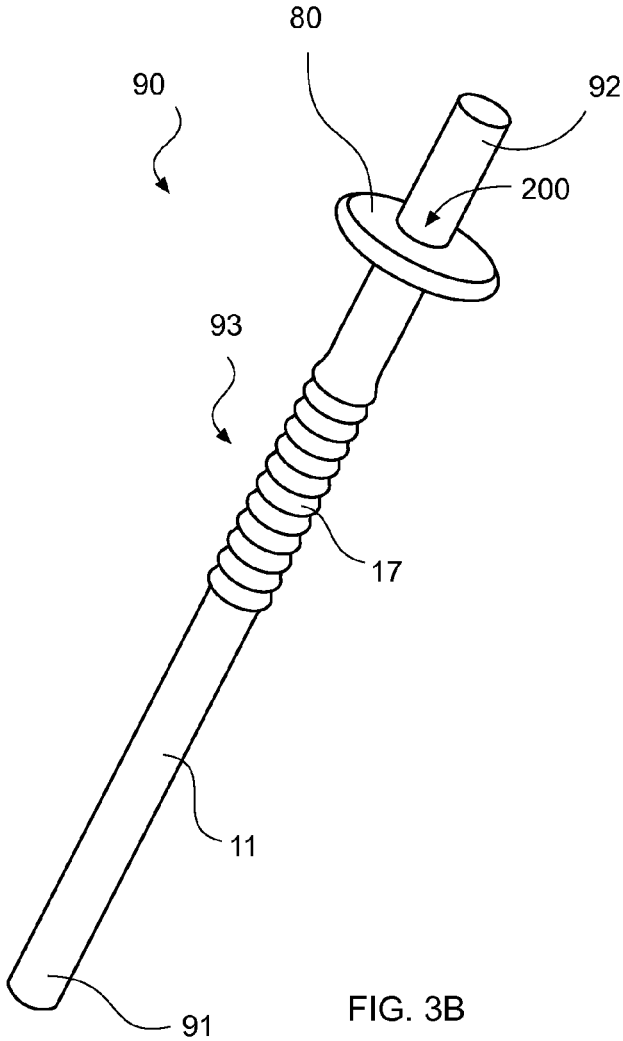
FIG. 3B is a perspective view of a safety straw with a removable disk barrier thereon according to an alternate embodiment.

Referring now more specifically to FIG. 3B, illustrated therein is an alternate embodiment of safety straw 90, wherein the alternate embodiment of FIG. 3B is substantially equivalent in form and function to that of the preferred embodiment detailed and illustrated in FIGS. 1A-3A except as hereinafter specifically referenced. Specifically, the embodiment of FIG. 3B comprises detachable barrier 80, wherein detachable barrier 80 comprises throughhole 200, wherein straw 11 is inserted throughhole 200. Straw 11 comprises a bottom 91, bendable segment 93 and top 92, wherein bendable segment 93 comprises ridges 17, and wherein ridges 17 are annularly wider in diameter than throughhole 200.

In use, person P slides removable/detachable barrier 80 over top 92 until removable/detachable barrier 80 contacts ridges 17. Person P places straw 11 into container C holding liquid L (best shown in FIG. 2). Person P then places top 92 into his or her mouth and sips liquid L, whereby liquid L travels through bottom 91 to person P via top 92. Contact of barrier 80 with person P prevents straw 11 being drawn too far into person P's mouth.

In an alternate embodiment of safety straw 90, safety straw 90 could be straight without bendable segment 93, comprising at least one ridge 17 on safety straw 90 to limit travel of barriers 100, 80.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A safety straw comprising:

a tubular section comprising a bendable segment at a top portion of said tubular section; and a barrier, wherein said barrier is disposed above said bendable segment of said tubular section, and wherein said barrier comprises a mouthpiece, a disc-shaped flange and a trumpet-flare-shaped portion, and wherein said trumpet-flare-shaped portion comprises a first end and a second end, and wherein said first end is disposed in contact with said disc-shaped flange, and wherein said first end is larger in diameter than said second end, and wherein said mouthpiece retains the shape of said tubular section, and wherein said mouthpiece extends away from said disc-shaped flange opposite to said trumpet-flare-shaped portion, and wherein said disc-shaped flange comprises an opening in the center thereof, and wherein said bendable segment comprises ridges annularly wider than said opening of said disc-shaped flange, and wherein said tubular section is inserted through said opening.

2. The safety straw of claim 1, wherein said barrier is annular in shape.

3. The safety straw of claim 1, wherein said barrier is molded with said tubular section as a unit.

4. The safety straw of claim 1, wherein said barrier is removable from said tubular section.

5. The safety straw of claim 1, wherein said mouthpiece is smaller in diameter than said disc-shaped flange.

6. A method of drinking from a straw, said method comprising the steps of:

obtaining a straw and a barrier, and wherein said barrier comprises a disc-shaped flange and a trumpet-flare-shaped portion, and wherein said trumpet-flare-shaped portion comprises a first end and a second end, and wherein said first end is disposed against said disc-shaped flange, and wherein said first end is larger in diameter than said second end, wherein said straw comprises a bendable segment, and wherein said barrier comprises a mouthpiece that retains the shape of said straw, and wherein said barrier is disposed above said bendable segment of said straw, and wherein said mouthpiece extends away from said disc-shaped flange opposite to said trumpet-flare-shaped portion;

placing said straw into a container with liquid therein; and inserting said mouthpiece into a person's mouth.

7. The method of drinking from a straw of claim 6, said method further comprising the step of:

sliding said barrier onto said straw.

8. The method of drinking from a straw of claim 6, wherein said mouthpiece is smaller in diameter than said disc-shaped flange.

* * * * *